US009435564B2

(12) United States Patent
Ma

(10) Patent No.: US 9,435,564 B2
(45) Date of Patent: Sep. 6, 2016

(54) CONVECTIVE HEAT TRANSFER FLUE

(71) Applicant: Chengguo Ma, Shuangyashan (CN)

(72) Inventor: Chengguo Ma, Shuangyashan (CN)

( * ) Notice: Subject to any disclaimer, the term of this patent is extended or adjusted under 35 U.S.C. 154(b) by 0 days.

(21) Appl. No.: 14/909,268

(22) PCT Filed: Aug. 1, 2014

(86) PCT No.: PCT/CN2014/083532
§ 371 (c)(1),
(2) Date: Feb. 1, 2016

(87) PCT Pub. No.: WO2015/014314
PCT Pub. Date: Feb. 5, 2015

(65) Prior Publication Data

US 2016/0169554 A1 Jun. 16, 2016

(30) Foreign Application Priority Data

Aug. 2, 2013 (CN) ..... 2013 1 0343824

(51) Int. Cl.
*F22B 7/18* (2006.01)
*F24H 9/00* (2006.01)
*F24D 19/08* (2006.01)

(52) U.S. Cl.
CPC ..... *F24H 9/0031* (2013.01); *F24D 19/083* (2013.01)

(58) Field of Classification Search
CPC .. F23C 7/006; C23C 16/4412; G01J 3/0232; B60K 11/085; F24B 1/189
USPC ..... 122/135.1, 155.1, 135.3
See application file for complete search history.

(56) References Cited

U.S. PATENT DOCUMENTS 2,716,021 A 8/1955 Evans et al.
2,842,076 A * 7/1958 Martin ..... F23L 13/06 110/296
2,894,493 A * 7/1959 De Leonardis ..... F24H 1/26 122/135.1
3,477,411 A * 11/1969 Gething ..... F22B 9/14 122/135.1
4,576,121 A * 3/1986 Thorogood ..... F22D 1/06 122/20 B (Continued)

FOREIGN PATENT DOCUMENTS

CN 201233135 Y 5/2009
CN 102200288 A 9/2011
CN 202303414 U 7/2012

(Continued)

OTHER PUBLICATIONS

PCT International Search Report, Application No. PCT/CN2014/083532, dated Nov. 6, 2014.

*Primary Examiner* — Gregory A Wilson
(74) *Attorney, Agent, or Firm* — MacMillan, Sobanski & Todd, LLC

(57) ABSTRACT

A convective heat transfer flue, including a flue wall (1) and convective heating surface groups (2) arranged inside the flue wall (1), shutters adjustable through 90 degrees or sliding gates (9) are arranged between adjacent convective heating surface groups and at a flue gas inlet and a flue gas outlet of the convective heat transfer flue. The proposed flue solves the problems of fouling within back-flow vortex regions of heat transfer pipes, and condensation on heating surfaces in the tail of the flue wall (1), as well as being beneficial for boiler start-up and load adjustment thereof.

4 Claims, 2 Drawing Sheets

(56) References Cited

U.S. PATENT DOCUMENTS 4,643,165 A * 2/1987 Chamberlain ..... F24B 5/026 126/112
5,452,686 A * 9/1995 Stahl ..... F22B 35/007 122/135.1
7,814,868 B2 * 10/2010 Yin ..... F24H 1/205 122/13.01
2010/0107993 A1 * 5/2010 Lyons ..... F24H 9/0026 122/13.01
2012/0305818 A1 * 12/2012 Charnesky ..... B60K 11/085 251/212
2015/0197148 A1 * 7/2015 Kobayashi ..... B60K 11/085 701/49

FOREIGN PATENT DOCUMENTS

CN 203549865 U 4/2014
WO 2010031818 A2 3/2010

* cited by examiner

CONVECTIVE HEAT TRANSFER FLUE

TECHNICAL FIELD

The present disclosure relates to a convective heat transfer flue of a boiler, and in particular to a controllable multidirectional-flow convective heat transfer flue capable of resisting fouling or ash deposition and resisting dewing and capable of tracking load.

BACKGROUND

The prior convective heat transfer flue of a boiler is just composed of a flue wall and convective heating surface groups arranged in the flue wall. Flue gas in a furnace enters the convective heat transfer flue via a flue gas inlet of the convective heat transfer flue and advances to a flue gas outlet of the convective heat transfer flue. The travelling path of the flue gas is a straight cylindrical path with a fixed section, with the advancing direction of the flue gas, the flue gas velocity and the zones of the convective heating surface groups swept by the flue gas non-adjustable. As the advancing direction of the flue gas in the convective heat transfer flue is non-adjustable, it leads to a defect that, when the flue gas transversely sweeps over flue gas-water heat transfer tubes arranged in the convective heating surface groups, a vortex (negative pressure) region generated on the backward surfaces of the flue gas-water heat transfer tubes swept by the flue gas is always kept unchanged in position to thus form ash deposition. As the velocity of the flue gas entering the convective heat transfer flue is non-adjustable, it leads to a defect that, at a rated flue gas velocity, the flue gas temperature is greatly reduced after the flue gas interacts with a leading portion of the convective heating surface group in the flue wall, and then the flue gas temperature becomes too low when the flue gas reaches a trailing portion of the heating surface group, so that dew can be formed easily. As the heating surface area of the convective heating surface groups swept by flue gas is non-adjustable, it leads to a defect that, the flue gas is at a relatively low temperature in the starting-up phase or a low-load operation process of the boiler and however needs to sweep all the convective heating surface groups, thereby resulting in a continuous significant reduction of the flue gas temperature, and then when the flue gas reaches the tail heating surface in the flue wall, the flue gas temperature is the lowest to form dew on the tail heating surface.

SUMMARY OF THE INVENTION

The technical problem to be solved by the present disclosure includes: a vortex (negative pressure) region generated on the backward surfaces of the flue gas-water heat transfer tubes swept by the flue gas is always kept unchanged in position to thus form ash deposition when the flue gas transversely sweeps over flue gas-water heat transfer tubes arranged in the convective heating surface groups, as the advancing direction of the flue gas in the convective heat transfer flue is non-adjustable; and dew can be formed easily at a rated flue gas velocity, since the flue gas temperature is greatly reduced after the flue gas interacts with a leading portion of the convective heating surface group in the flue wall, and then the flue gas temperature becomes too low when the flue gas reaches a trailing portion of the heating surface group, as the velocity of the flue gas entering the convective heat transfer flue is non-adjustable; and as the heating surface area of the convective heating surface groups swept by flue gas is non-adjustable, the flue gas is at a relatively low temperature in the starting-up phase or a low-load operation process of the boiler and however needs to sweep all the convective heating surface groups, thereby resulting in a continuous significant reduction of the flue gas temperature, and then when the flue gas reaches the tail heating surface in the flue wall, the flue gas temperature is the lowest to form dew on the tail heating surface.

In order to solve the above-mentioned technical problems, the following technical solutions are proposed by the present disclosure.

Solution 1: A controllable multidirectional-flow convective heat transfer flue capable of resisting ash deposition and resisting dewing and of tracking load, including a flue wall and convective heating surface groups arranged inside the flue wall, wherein at least 90 degree adjustable shutters are arranged between adjacent convective heating surface groups and at a flue gas inlet and a flue gas outlet of the convective heat transfer flue, and each layer of shutters include a plurality of shutters, and a frame for carrying shutters via a plurality of pivot shafts is fixed to an inner side or outer side of the flue wall; and each shutter is mounted on a respective pivot shaft connected to an actuation mechanism enabling the pivot shaft to rotate at least through 90 degrees.

Solution 2: A controllable multidirectional-flow convective heat transfer flue capable of resisting ash deposition and dewing and tracking load, including a flue wall and a convective heating surface group arranged inside the flue wall, wherein between adjacent convective heating surface groups, as well as at a flue gas inlet and a flue gas outlet of the convective heat transfer flue, there are sliding gates provided, and each sliding gate is cooperated with a slide fixed on an inner side of the flue wall and with a corresponding sliding gate push-pull opening sealingly formed in the flue wall, and each sliding gate is coupled to an actuation mechanism enabling the sliding gate to move back and forth.

Due to the shutter or sliding gate structure design, the present disclosure may provide a beneficial effect as follows over prior arts. Firstly, when the shutters or sliding gates are regularly switched to be opened and closed on the left side and on the right side, combined with vertically offset opening and closing, the flue gas is travelled in each flue segment with a travelling direction regularly alternated between a leftward travelling direction and a rightward travelling direction. Thus, when the flue gas transversely sweeps over flue gas-water heat transfer tubes arranged in the convective heating surface groups, the backward surfaces of the flue gas-water heat transfer tubes where a vortex (negative pressure) is generated may be used as "front faces" so that the previously deposited ash may be blown away, thereby resisting ash reposition. Secondly, when all shutters or sliding gates are completely or fully opened, the travelling path of the flue gas in the controllable multidirectional-flow convective heat transfer flue is a straight cylindrical path with a large section. When the flue gas enters at a rated velocity into the controllable multidirectional-flow convective heat transfer flue, the flue gas velocity decreases and the flue gas temperature is not greatly reduced, and therefore the temperature is not too low to form dew when the flue gas reaches the tail heating surface in the flue wall. Thus, dewing resistance is realized. Thirdly, when the shutters or the sliding gates are synchronously and partially closed, the flue gas only partially sweeps over each one of the convective heating surface groups in the controllable multidirectional-flow convective heat transfer flue and the heating surfaces are reduced. Thus, in the starting-up phase or low-load operation process of the boiler, the flue gas at a relatively low temperature is prevented from a high degree of reduction in temperature. Then, dew formation on the tail heating surface can be avoided when the flue gas reaches the tail heating surface in the flue wall, namely dewing resistance is realized. Meanwhile, it is advantageous for starting up of the boiler, and a big adjustment of the load of the boiler, i.e., load tracking. As a result, the damage due to mismatch between the capacity of the boiler and the load amount can be avoided.

DETAILED DESCRIPTION OF THE EMBODIMENTS

Preferred embodiments of the present disclosure are given below with reference to the accompanying drawings.

Figure 1:
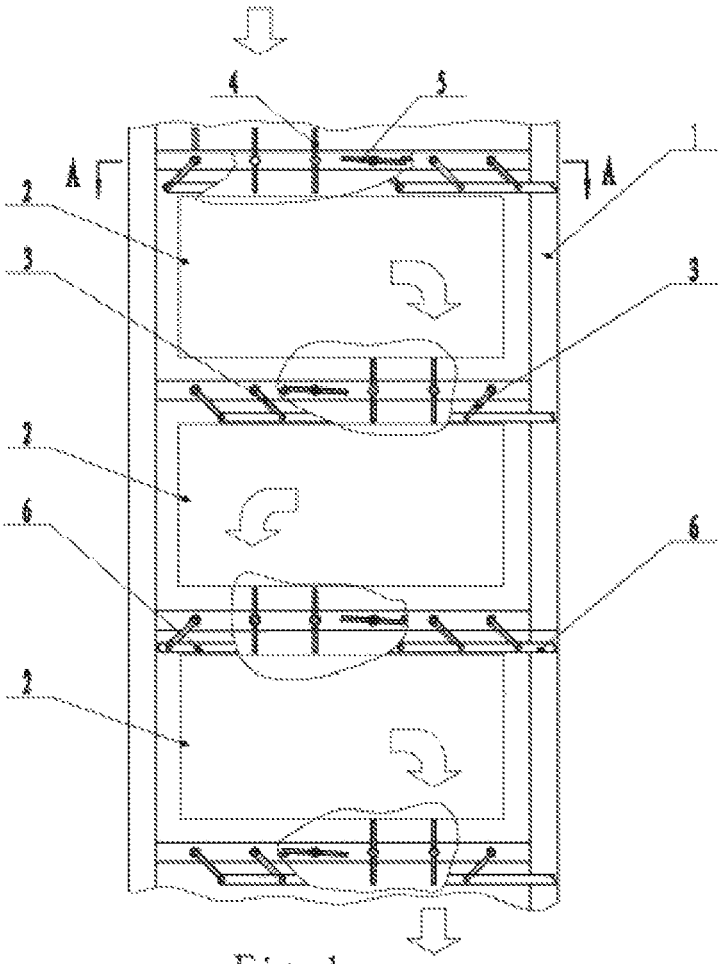
FIG. 1 is a partial sectional schematic front view of a controllable multidirectional-flow convective heat transfer flue or gas pass capable of resisting fouling or ash deposition, and of resisting dewing and of tracking load, with at least 90 degree adjustable shutters arranged between adjacent convective heating surface groups and at a flue gas inlet and a flue gas outlet of each convective heat transfer flue segment.
Figure 2:
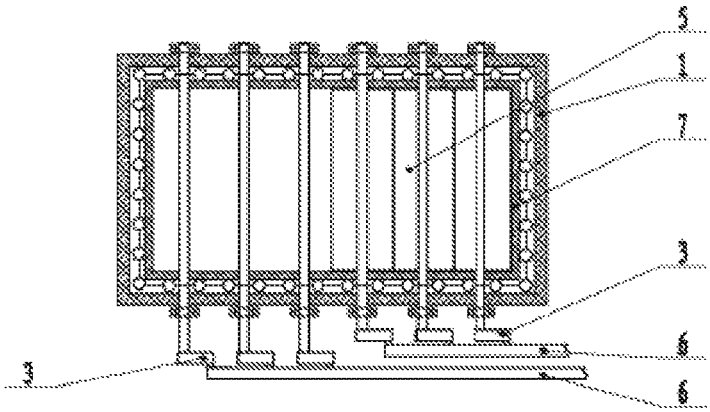
FIG. 2 is a sectional view of the controllable multidirectional-flow convective heat transfer flue taken along line A-A in FIG. 1.

A controllable multidirectional-flow convective heat transfer flue capable of resisting fouling or ash deposition, and of resisting dewing and of tracking load, as shown in FIGS. 1 and 2, includes a flue wall 1 and convective heating surface groups 2 arranged inside the flue wall 1. Between adjacent convective heating surface groups 2, as well as at a flue gas inlet and a flue gas outlet of each convective heat transfer flue segment, there are arranged a layer of shutters which are adjustable within a range of 90 degrees. Each layer of shutters may be divided into a left group of shutters 4 and a right group of shutters 5. A frame 7 for carrying shutters is fixed to an inner side of the flue wall 1. An actuation mechanism allowing the shutters to rotate by 90 degrees includes a swing rod 3 and a connecting rod 6. The swing rod 3 is coupled to an end of a respective pivot shaft onto which the respective shutter is fixed, and then the swing rod 3 is hinged at its one end to the corresponding connecting rod 6. In order to facilitate installation, maintenance and heat transfer, two layers of shutters capable of acting synchronously as one layer can be arranged between adjacent convective heating surface groups 2. For big boilers, the shutters may be further supported by cross beams arranged inside the flue wall 1.

Figure 3:
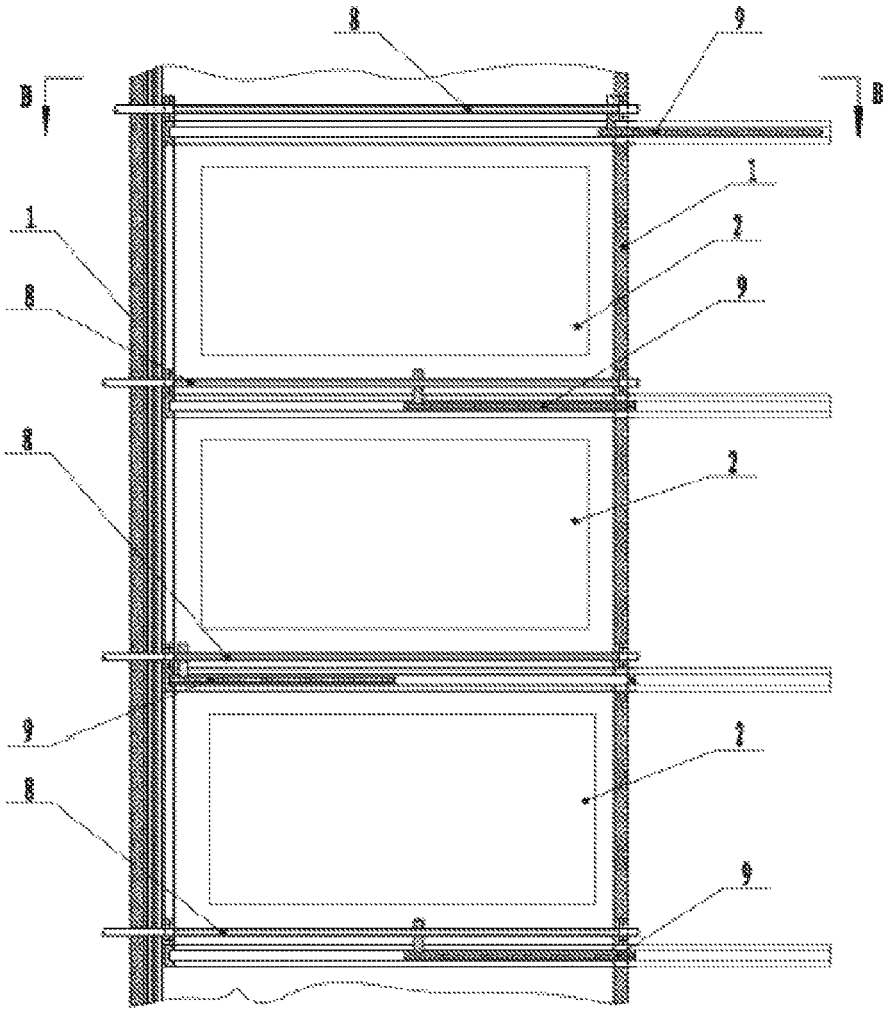
FIG. 3 is a partial sectional schematic front view of a controllable multidirectional-flow convective heat transfer flue or gas pass capable of resisting fouling or ash deposition, and of resisting dewing and of tracking load, with sliding gates arranged between adjacent convective heating surface groups and at a flue gas inlet and a flue gas outlet of each convective heat transfer flue segment.
Figure 4:
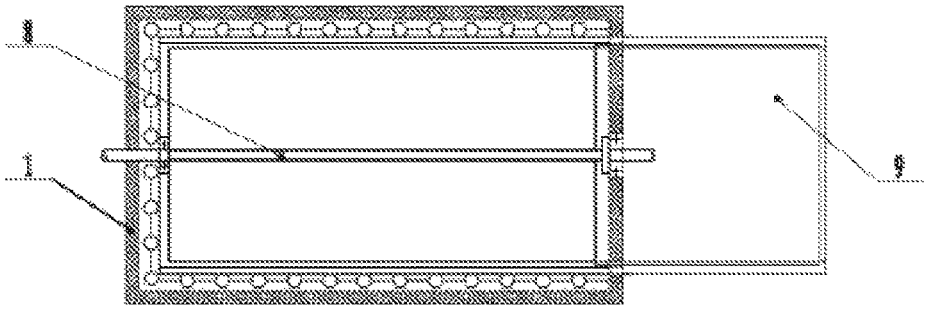
FIG. 4 is a sectional view of the controllable multidirectional-flow convective heat transfer flue taken along line B-B in FIG. 3.

A controllable multidirectional-flow convective heat transfer flue capable of resisting ash deposition and dewing and tracking load as shown in FIGS. 3 and 4 includes a flue wall 1 and convective heating surface groups 2 arranged inside the flue wall 1. Between adjacent convective heating surface groups 2, as well as at a flue gas inlet and a flue gas outlet of each convective heat transfer flue segment, there are sliding gates 9. Each sliding gate 9 is cooperated with a slide fixed on an inner side of the flue wall 1 and with a corresponding sliding gate push-pull opening sealingly formed in the flue wall 1. An actuation mechanism enabling the sliding gate to move back and forth includes a lead screw 8. The lead screw 8 is cooperated with a nut on the corresponding sliding gate 9 and with a lead screw access hole sealingly formed in the flue wall 1.

The shutters and the sliding gates 9 are made of common carbon steel or heat-resistant and corrosion-resistant alloy steel. In use, the connecting rod 6 or the lead screw 8 are operated manually or automatically, so that the two groups 4 and 5 of shutters or the sliding gates 9 are regularly switched to be opened or closed on the left side and on the right side, and also in an interlaced or staggered manner among different layers, and therefore the convective heating surface can realize ash deposition resistance. When the two groups 4 and 5 of shutters or the sliding gates 9 are completely opened so as to provide a rated flue gas velocity, dewing on the tail heating surface in the flue wall 1 can be resisted. A single group 4 or 5 of shutters or the sliding gates 9 may be closed synchronously on the left side or on right side so as to facilitate a starting-up phase of the boiler and/or adjust a load of the boiler, namely tracking the load. When the boiler is deactivated, it is further advantageous for high-speed air to sweep away the deposited ash on the convective heating surface groups 2.

The invention claimed is:

1. A boiler comprising a controllable multidirectional-flow convective heat transfer flue capable of resisting ash deposition and resisting dewing and of tracking load, the flue including a flue wall and convective heating surface groups arranged inside the flue wall, the flue including one or more flue segments which are vertically continuous with each other, wherein each flue segment has a flue gas inlet and a flue gas outlet arranged in an upper end face and a lower end face of each flue segment respectively, and at least 90 degree adjustable shutters are arranged at both the flue gas inlet and the flue gas outlet of each flue segment to adjust positions of actual flue gas ingress and egress regions of the flue gas inlet and the flue gas outlet so that the positions of the actual flue gas ingress and egress regions are vertically staggered from each other, and thus a serpentine flue gas travelling path is formed in case of a plurality of flue segments; each layer of shutters includes a plurality of shutters; and a frame for carrying shutters via a plurality of pivot shafts is fixed to an inner side or outer side of the flue wall; and the respective shutter is mounted on the respective pivot shaft connected to an actuation mechanism enabling the pivot shaft to rotate at least through 90 degrees, so that when the shutters at the flue gas inlet and the flue gas outlet of each flue segment are regularly switched to be opened and closed, the flue gas is travelled in each flue segment with a travelling direction regularly alternated between a leftward travelling direction and a rightward travelling direction.

2. The boiler of claim 1, wherein the actuation mechanism enabling the pivot shaft to rotate through 90 degrees includes a swing rod and a connecting rod; and the swing rod is at an end fixed to an end of the respective pivot shaft and at the other end is hinged to the corresponding connecting rod.

3. A boiler comprising a controllable multidirectional-flow convective heat transfer flue capable of resisting ash deposition and resisting dewing and of tracking load, the flue including a flue wall and convective heating surface groups arranged inside the flue wall, the flue being composed of one or more flue segments which are vertically continuous with each other, wherein each flue segment has a flue gas inlet and a flue gas outlet arranged in an upper end face and a lower end face of each flue segment respectively, and sliding gates are arranged at both the flue gas inlet and the flue gas outlet of each flue segment to adjust positions of actual flue gas ingress and egress regions of the flue gas inlet and the flue gas outlet so that the positions of the actual flue gas ingress and egress regions are vertically staggered from each other, and thus a serpentine flue gas travelling path is formed in case of a plurality of flue segments; each sliding gate is cooperated with a slide fixed on the inner wall of the flue wall and a corresponding sliding gate push-pull opening sealingly formed in the flue wall; each sliding gate is connected with an actuation mechanism enabling the sliding gate to move back and forth, so that when the sliding gates at the flue gas inlet and the flue gas outlet of each flue segment are regularly switched to be opened and closed, the flue gas is travelled in each flue segment with a travelling direction regularly alternated between a leftward travelling direction and a rightward travelling direction.

4. The boiler of claim 3, wherein the actuation mechanism includes a lead screw cooperated with a nut on the corresponding sliding gate and with a lead screw access hole sealingly formed in the flue wall.

* * * * *